US011473331B2

(12) United States Patent
Merendino et al.

(10) Patent No.: US 11,473,331 B2
(45) Date of Patent: Oct. 18, 2022

(54) HYBRID MAUSOLINO

(71) Applicant: Merendino Contracting, Inc., Linden, NJ (US)

(72) Inventors: Angelo Merendino, Phillipsburg, NJ (US); Biagio Merendino, South Plainfield, NJ (US)

(73) Assignee: Merendino Contracting, Inc., Linden, NJ (US)

( * ) Notice: Subject to any disclaimer, the term of this patent is extended or adjusted under 35 U.S.C. 154(b) by 18 days.

(21) Appl. No.: 17/217,502

(22) Filed: Mar. 30, 2021

(65) Prior Publication Data

US 2021/0310271 A1 Oct. 7, 2021

Related U.S. Application Data

(60) Provisional application No. 63/003,546, filed on Apr. 1, 2020.

(51) Int. Cl.

| | |
|---|---|
| ***E04H 13/00*** | (2006.01) |
| ***E04B 1/343*** | (2006.01) |
| ***E04F 13/14*** | (2006.01) |
| ***E04B 1/24*** | (2006.01) |

(52) U.S. Cl.

CPC ..... *E04H 13/006* (2013.01); *E04B 1/24* (2013.01); *E04B 1/34321* (2013.01); *E04F 13/144* (2013.01)

(58) Field of Classification Search

CPC ..... E04H 13/006; E04H 13/008; E04B 1/24; E04B 1/34321; E04F 13/144

See application file for complete search history.

(56) References Cited

U.S. PATENT DOCUMENTS 3,925,944 A * 12/1975 Pickel ..... E04H 13/006 52/133
4,614,066 A * 9/1986 Koppenberg ..... E04H 13/006 52/79.9
5,195,812 A * 3/1993 Eickhof ..... A47B 47/0091 312/257.1
5,477,594 A * 12/1995 LePage ..... E04H 13/006 211/84
5,622,014 A * 4/1997 Weiss ..... E04H 13/006 52/134
5,881,505 A * 3/1999 Larkin, III ..... E04H 13/006 211/85.27

(Continued)

*Primary Examiner* — Rodney Mintz

(74) *Attorney, Agent, or Firm* — Buchanan Ingersoll & Rooney PC

(57) ABSTRACT

A hybrid mausolino system that includes a metal frame structure forming levels within which a crypt area and a niche area are defined. The metal frame structure forms an upper level that resides just below a roof and includes a plurality of inter-locking panels that partition this level into niche spaces. Some embodiments include a removable roof with a lintel structure having access ports positioned over the niche spaces and lids secured to each access port. The reconfigurable niche spaces allow for adjustment of niche spaces to provide for increased versatility and efficient use of mausolino space. The niche spaces are horizontally orientated and can be accessed via a side panel of the structure for interment or disinterment. With embodiments having a removable roof, the niche spaces can be accessed via a side panel, or the roof can be removed allowing for top access to the niche space.

15 Claims, 13 Drawing Sheets

(56) References Cited

U.S. PATENT DOCUMENTS 6,105,315 A * 8/2000 Stoecklein ..... E04H 13/006 52/439
6,324,737 B1 * 12/2001 Chamness ..... E04H 13/006 27/1
6,944,921 B1 * 9/2005 Gersten ..... E04H 13/008 27/1
7,739,776 B2 6/2010 Hume
7,908,800 B2 * 3/2011 Bach Lahor ..... E04H 13/006 52/36.5
9,080,344 B2 * 7/2015 Young ..... E04H 13/006
9,157,252 B2 * 10/2015 School ..... E04H 13/006
9,249,598 B2 * 2/2016 Bridgeman ..... E04H 13/006
10,107,004 B1 * 10/2018 Mercer ..... E05B 63/00
10,125,514 B2 * 11/2018 Eickhof ..... E04H 13/006
10,487,529 B2 * 11/2019 Tollefson ..... E04H 13/003
10,604,959 B2 * 3/2020 Eickhof ..... E04H 13/006
11,124,986 B1 * 9/2021 Buehrer ..... E04H 13/006
2008/0196225 A1 * 8/2008 Pruitt ..... A61G 17/0405 27/1
2009/0199376 A1 * 8/2009 Hume ..... E04H 13/006 27/1
2009/0229197 A1 * 9/2009 Bach Lahor ..... E04H 13/006 52/142
2009/0282752 A1 * 11/2009 Stilnovich ..... E04H 13/006 52/133
2010/0275529 A1 * 11/2010 Bridgemen ..... E04H 13/006 52/134
2011/0154748 A1 * 6/2011 Young ..... E04H 13/006 52/745.01
2012/0042489 A1 * 2/2012 Cai ..... E04H 13/006 27/35
2015/0052830 A1 * 2/2015 School ..... E04H 13/006 52/134
2015/0275539 A1 * 10/2015 Willis ..... E04H 13/006 52/133
2016/0356055 A1 * 12/2016 Trousil ..... E04H 13/006
2017/0211291 A1 * 7/2017 Eickhof ..... A61G 17/08
2018/0179778 A1 * 6/2018 Tollefson ..... E04H 13/006
2018/0223558 A1 * 8/2018 Birkmeier ..... E04H 13/008
2018/0283035 A1 * 10/2018 Mercer ..... E05B 65/0057
2019/0277052 A1 * 9/2019 Eickhof ..... E04H 13/006
2021/0246684 A1 * 8/2021 Lao Hernández ..... A61G 17/08

* cited by examiner

HYBRID MAUSOLINO

CROSS-REFERENCE TO RELATED APPLICATIONS

This patent application claims the benefit of and priority to U.S. Provisional Patent Application No. 63/003,546, filed on Apr. 1, 2020, which is hereby incorporated by reference in its entirety.

FIELD OF THE INVENTION

Embodiments relate to a mausoleum/columbarium system that has reconfigurable niche spaces for interment and disinterment of miscarried and stillborn children.

BACKGROUND OF THE INVENTION

Burial space in conventional cemetery mausoleums is scarce and limited. Furthermore, interment and disinterment is currently performed horizontally (moving remains in and out via a horizontally accessed interment areas and via horizontal movement of the remains). This limits the functionality of the mausoleum, and especially for disinterment operations. Not only does this require horizontal movement in compromising spaces, it also requires relocating remains in interment to obtain access to the space targeted for burial.

In addition, conventional mausoleums have a "one-size fits all" approach to accommodating burial containers of miscarried children. Yet, burial containers of miscarried children are randomly size and the size of them is unpredictable. This "one-size fits all" approach results in an inefficient use of valuable space.

The present invention is directed toward overcoming one or more of the above-mentioned problems, though not necessarily limited to embodiments that do.

SUMMARY OF THE INVENTION

The hybrid mausolino system includes a metal frame structure forming levels within which a crypt area (e.g., for interment and memorializing cremation urns and full body caskets) and a niche area having reconfigurable niche spaces (e.g., for temporarily interment (e.g., 13 weeks) and disinterment of miscarried stillborn caskets) are defined. The metal frame structure forms an upper level that resides just below the roof. This upper level includes a plurality of inter-locking panels that partition this level into reconfigurable niche spaces. This upper level may also have access ports for the niche spaces, wherein the access ports grant horizontal access to the niche spaces. The reconfigurable niche spaces allow for adjustment of niche spaces to provide for increased versatility and efficient use of mausolino space. The niche spaces are horizontally orientated and can be horizontally accessed via a side panel of the structure for interment or disinterment. The metal frame structure can be cladded with concrete or stone or provided with some other type of façade. While it is contemplated for the system to be configured to have four crypt spaces to inter full body caskets (e.g., 312 cremation urns) and an upper level with enough niche spaces to accommodate 90 miscarried stillborn caskets if they are 11"×5", the system can be configured for any number of crypts spaces and niche spaces. A niche space may be referred to herein as a mausolino. The system may be referred to herein as a hybrid mausolino.

In an alternative embodiment, the roof is removable. For instance, the upper level may include a lintel structure. The lintel structure may have access ports positioned over the niche spaces and a lid secured to each access port. Thus, the lintel structure can have vertical access ports. It should be noted that embodiments with a removable roof can also have the horizontal access ports described above. Hence, with embodiments having a removable roof, the niche spaces can be accessed via a side panel or, in addition or in the alternative, the roof (or at least a panel of the roof) can be removed allowing for removal of a niche space lid for a particular niche space to gain vertical access to the niche space.

In an exemplary embodiment, a hybrid mausolino system includes a metal frame structure defining a crypt area and a niche area. A plurality of reconfigurable, inter-locking panels are included within the niche area, the inter-locking panels being reconfigurable to form a desired number of niche spaces within the niche area. The metal frame structure includes an individual access port for each individual niche space, each individual access port granting horizontal access to its respective niche space.

In some embodiments, the system includes a roof structure having at least one removable panel, wherein the metal frame structure includes at least one access port to grant vertical access to at least one niche space.

In some embodiments, the metal frame structure is configured to form a plurality of crypt spaces within the crypt area, each crypt space being configured for interment and memorializing cremation urns.

In some embodiments, each niche space is configured for temporary interment and disinterment of miscarried stillborn caskets.

In some embodiments, a plurality of inter-locking panels are used within the niche space, which permits reconfiguring the niche space into a desired number of spaces.

In some embodiments, the plurality of inter-locking panels comprises: at least one permanently secured panel having at least one notch formed therein; and at least one removably secured panel configured to engage the permanently secured panel via the at least one notch.

In some embodiments, the at least one removably secured panel has a distal end that is angled.

In some embodiments, the metal frame structure is rectangular in shape and has a front face, a rear face, a first side face, and a second side face. The plurality of inter-locking panels comprises: a first permanently secured panel extending from the front face to the rear face; a second permanently secured panel extending from the front face to the rear face; a plurality of removably secured panels, each oriented in a direction that is orthogonal to the first permanently secured panel and the second permanently secured panel.

In some embodiments, the volumes of space between the front face, the rear face, the first side face, the second side face, the first permanently secured panel, the second permanently secured panel, and the plurality of removably secured panels define the desired number of niche spaces.

In some embodiments, the metal frame structure has a first level, a second level, a third level, a fourth level, and a fifth level. A volume of space between the second level and the third level defines a first crypt space of the crypt area. A volume of space between the third level and the fourth level defines a second crypt space of the crypt area. A volume of space between the fourth level and the fifth level defines the niche area.

In some embodiments, a lintel structure having vertical supports is used to define access ports.

In some embodiments, a stone façade is applied to the metal frame structure.

In some embodiments, at least one track and rail system is arranged within the volume of space between the second level and the third level. At least one track and rail system is arranged within the volume of space between the third level and the fourth level.

In some embodiments, a track and rail system is used within the crypt area.

In some embodiments, the track and rail system forms a shelf and is configured to extend the shelf out from the crypt area and retract the shelf into the crypt area.

In some embodiments, the shelf defines a plurality of tray areas, each tray area configured to receive a cremains container.

In some embodiments, a lock is used to facilitate locking the shelf at a desired position.

In some embodiments, a façade is applied to the metal frame structure. At least one face plate is secured to one or both of the front face and the second face.

In some embodiments, a façade is applied to the metal frame structure. At least one inscription plate secured to one or both of the first side face and the second side face.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

The above and other objects, aspects, features, advantages and possible applications of the present invention will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of the present invention. The scope of the present invention is not limited by this description.

Figure 1:
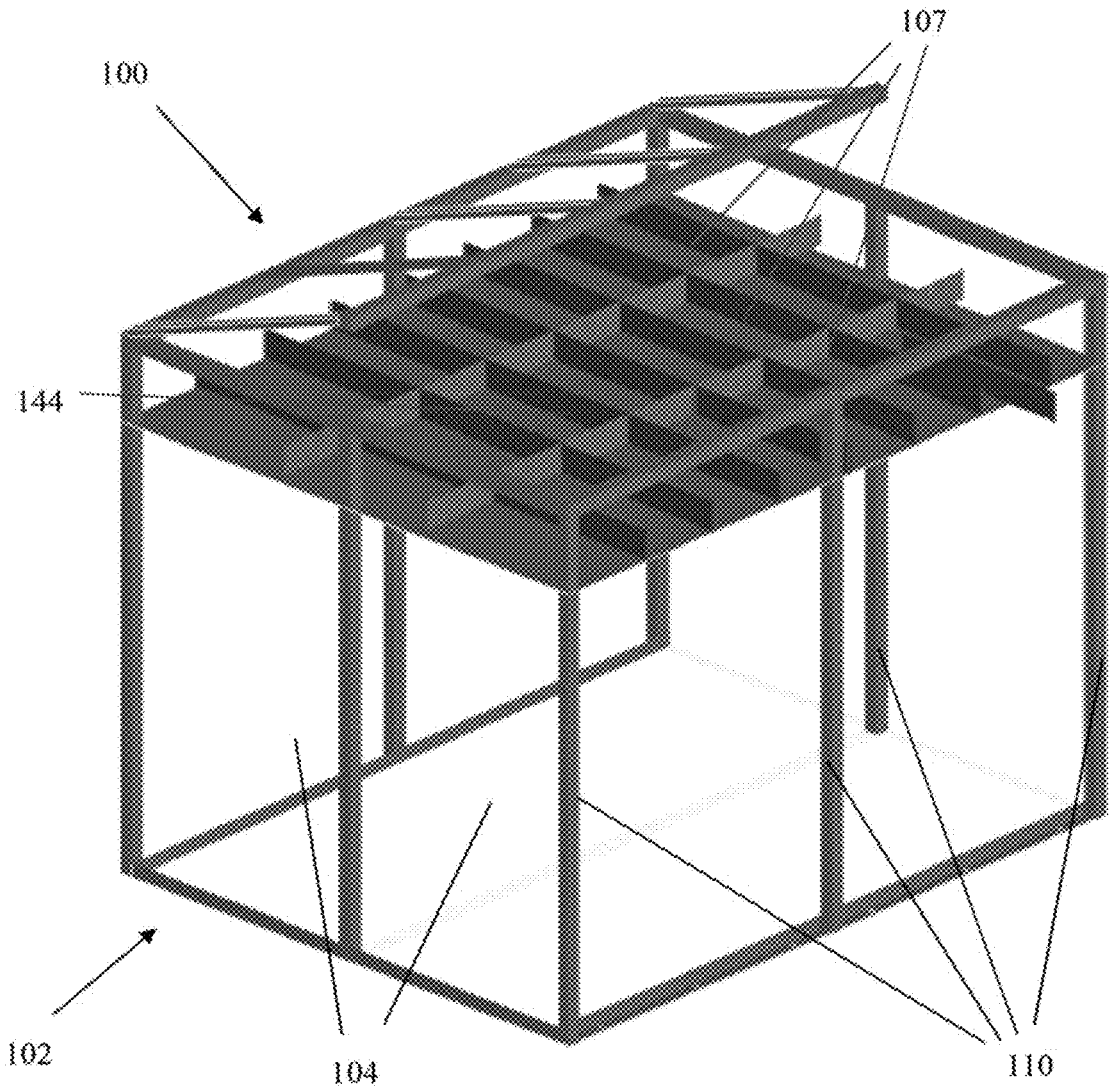
FIG. 1 shows an exemplary hybrid mausolino system illustrating the inter-locking panels forming a plurality of niche spaces.
Figures 2A, 2B:
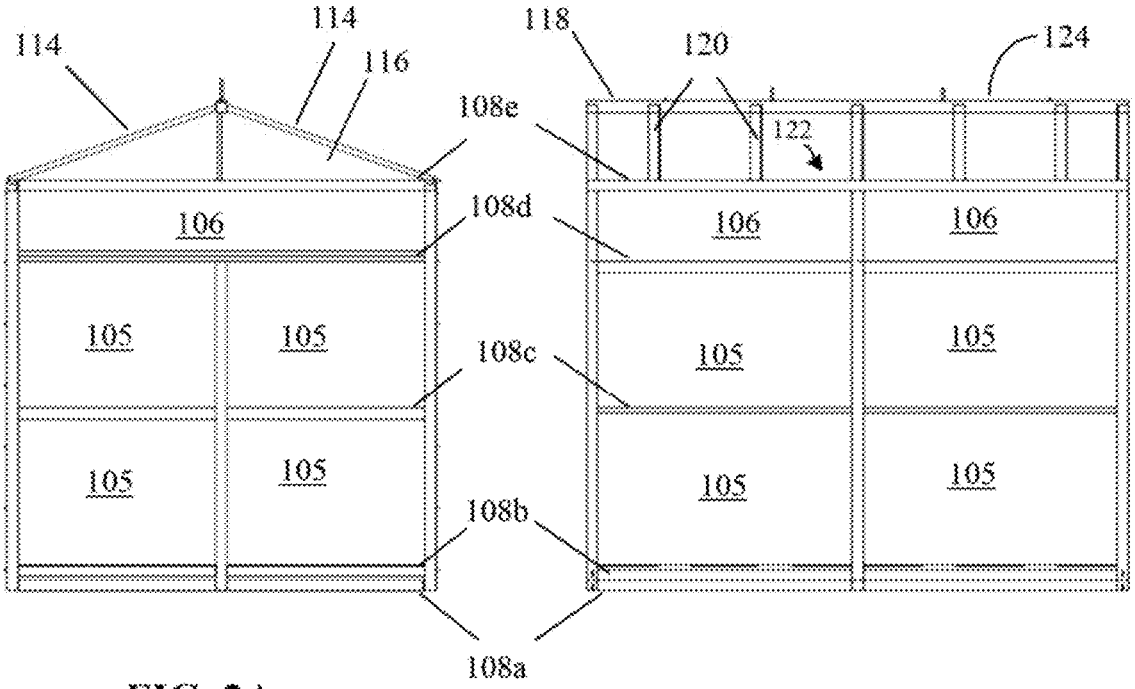
FIG. 2A shows a front view of an exemplary metal frame structure and FIG. 2B shows a side view thereof.
Figure 3:
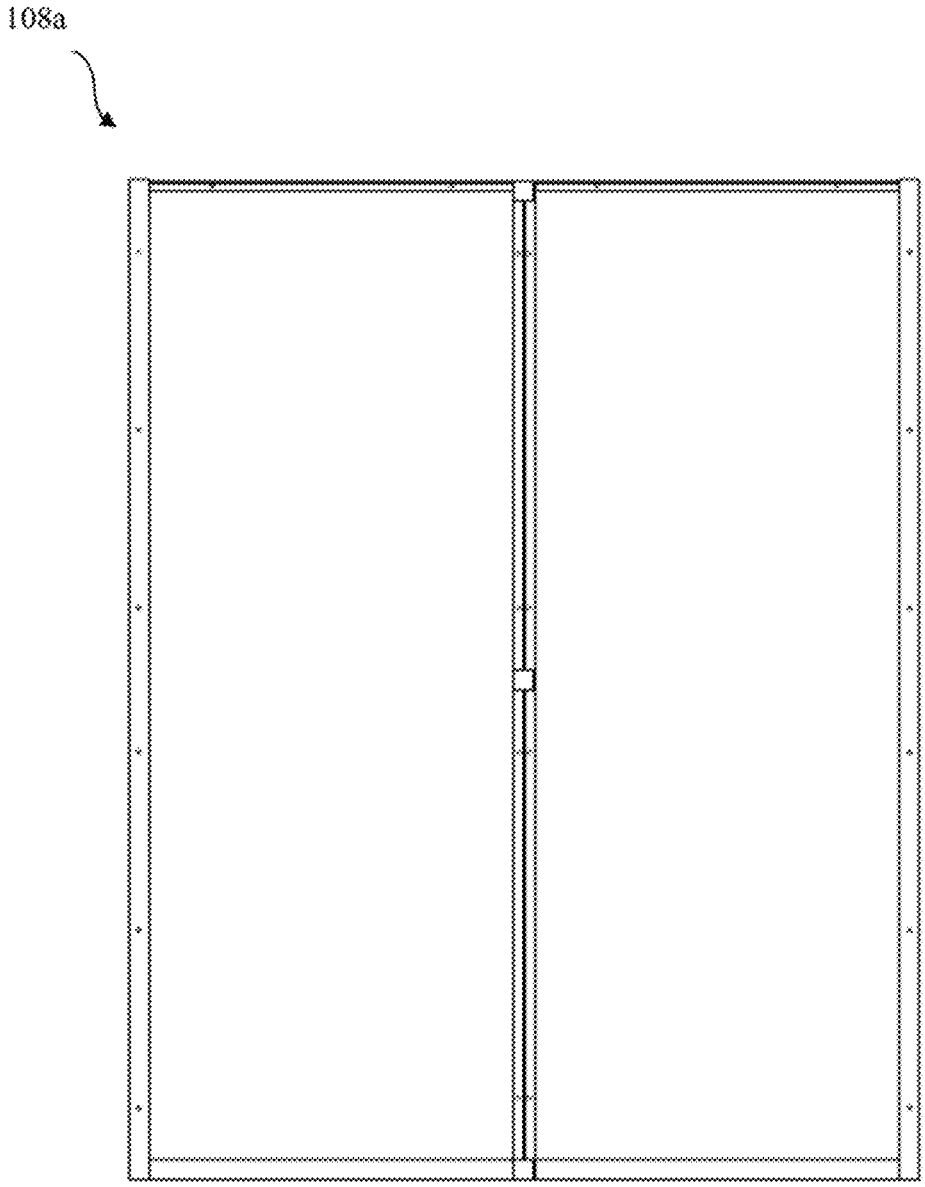
FIG. 3 shows an exemplary top down view of a first level of a metal frame structure.
Figure 4:
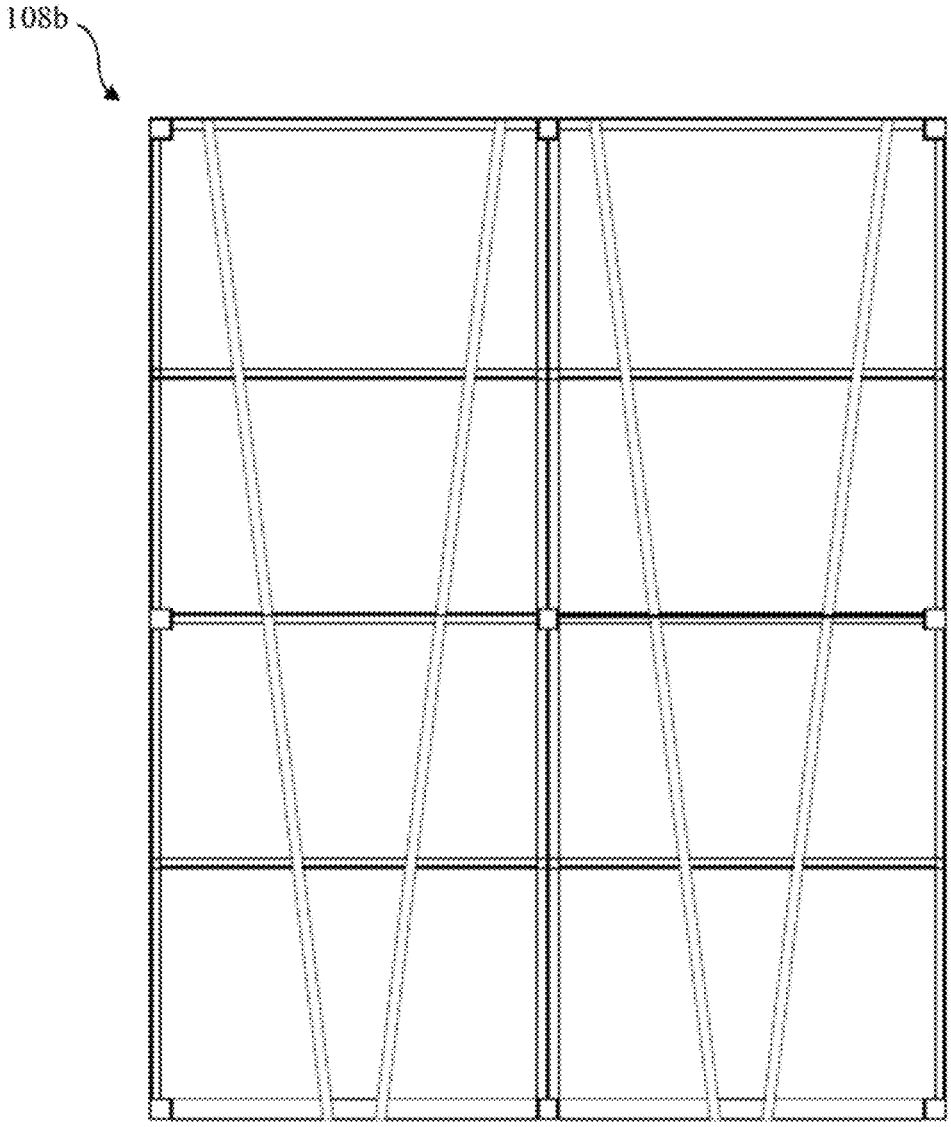
FIG. 4 shows an exemplary top down view of a second level of a metal frame structure.
Figure 5:
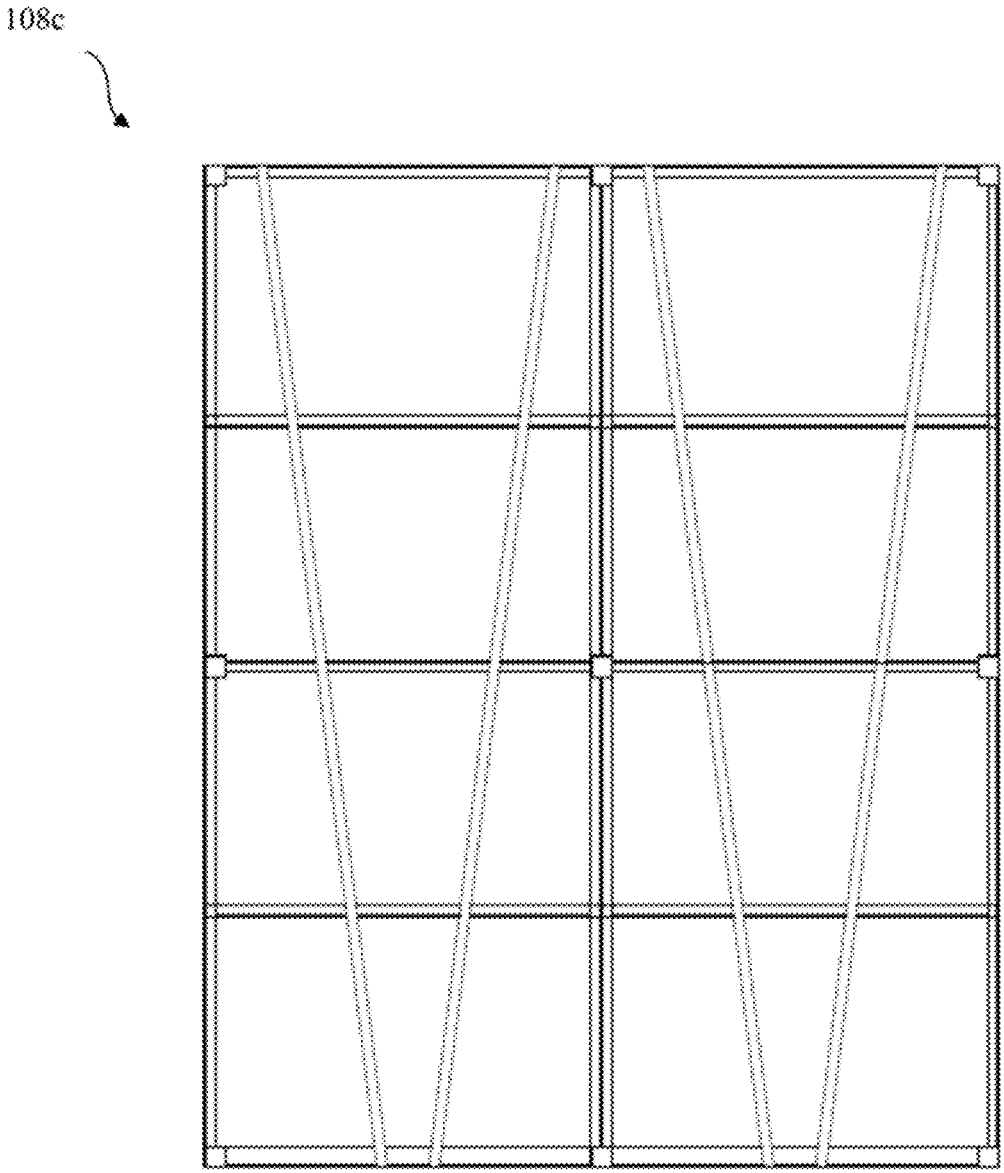
FIG. 5 shows an exemplary top down view of a third level of a metal frame structure.
Figure 6:
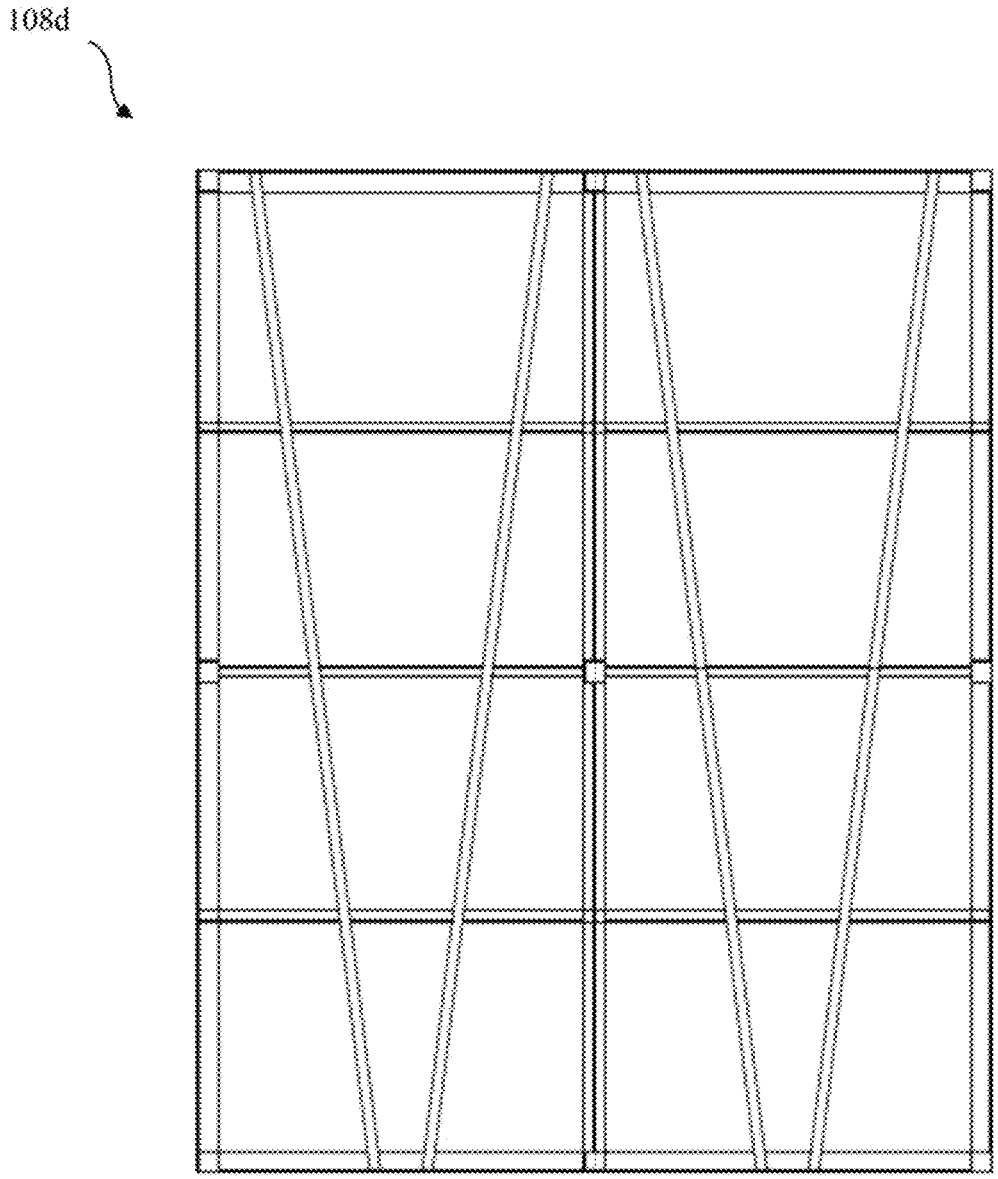
FIG. 6 shows an exemplary top down view of a fourth level of a metal frame structure.

Referring to FIGS. 1 and 2, the system 100 includes a metal frame structure 102 designed for use as a skeleton structure for a mausoleum and/or a columbarium. The metal frame structure 102 can include metal beams, attaching plates, rivets, bolts, etc. The metal beams can be steel, stainless steel, steel alloy, aluminum, other metal alloy, etc. The metal frame structure 102 defines at least two levels. At least one of the levels can be designated as a crypt area 104. In some embodiments, the metal frame structure 102 is configured to form a plurality of crypt spaces 105 within the crypt area 104. For instance, the metal frame structure 102 can have additional horizontal or vertical beams that segment the crypt area 104 into crypt spaces 105. Each crypt space 105 is configured for interment and memorializing cremation urns and/or full body caskets. At least one other level can be designated a niche area 106. As will be explained herein, a plurality of reconfigurable, inter-locking panels 144 can be used to form a desired number of niche spaces 107 within the niche area 106. The plurality of niche spaces 107 is one or more spaces that are reconfigurable into a desired number of spaces based on the configuration of the inter-locking panels 144. In one embodiment, the niche spaces 107 are configured for temporarily interment and disinterment of miscarried stillborn caskets.

In an exemplary embodiment, the metal frame structure 102 comprises a first level 108*a*, a second level 108*b*, a third level 108*c*, a fourth level 108*d*, and a fifth level 108*e*. More or less levels 108 can be used. Each level 108 is a metal grid structure that is horizontally oriented (e.g., parallel with the ground surface) and is secured to a vertical support beam arrangement 110. In an exemplary embodiment, the vertical support beam arrangement 110 includes four vertical pots positioned at the four corners of the metal frame structure 102. Depending on the size and desired crypt/niche space design, additional vertical posts are placed at intermediary positions between each corner post. The first level 108*a* is designed to rest or be attached (e.g., via rivets, bolts, mechanical anchors, epoxy, screws, etc.) to a foundation (e.g., a concrete pad) and provide foundational support and stability for the metal frame structure 102. The second level 108*b* rests or is attached (e.g., via rivets, bolts, mechanical anchors, epoxy, screws, etc.) to the first level 108*a* and/or the vertical support beam arrangement 110. The third level 108*c* is elevated with respect to the second level 108*b* and is attached (e.g., via rivets, bolts, mechanical anchors, epoxy, screws, etc.) to the vertical support beam arrangement 110. The fourth level 108*d* is elevated with respect to the third level 108*c* and is attached (e.g., via rivets, bolts, mechanical anchors, epoxy, screws, etc.) to the vertical support beam arrangement 110. The fifth level 108*e* is elevated with respect to the fourth level 108*d* and is attached (e.g., via rivets, bolts, mechanical anchors, epoxy, screws, etc.) to the vertical support beam arrangement 110.

Referring to FIGS. 3-9, each level 108 is a metal frame (e.g., a square, rectangular, etc. structure) having support cross-beams that are orthogonally or otherwise arranged. The shape of the metal frame and the number and arrangement of the cross-beams will depend on the architectural criteria of the mausoleum and/or a columbarium.

It is contemplated for the volume of space between the second and third levels 108 and the volume of space between the fourth and third levels 108 to be designated as crypt spaces 104. It is further contemplated for the distance between the second and third levels 108 to be equal to the distance between the fourth and third levels 108. It is contemplated for the volume of space between the fourth and fifth levels 108 to be designated as a niche area 106. A roof structure 112 is designed to rest upon and attached (e.g., via rivets, bolts, mechanical anchors, epoxy, screws, etc.) to the fifth level 108*e*. The roof structure 112 can be made of metal, wood, stone, etc. The roof structure 112 may also has a roof rafter to provide structural support for the roof structure 112. The roof structure 112 can be a pitched roof, a flat roof, angled roof, dome roof, etc. In some embodiments, a loft area 116 exists between the roof structure 112 and the fifth level 108*e*.

Figures 12A, 12B:
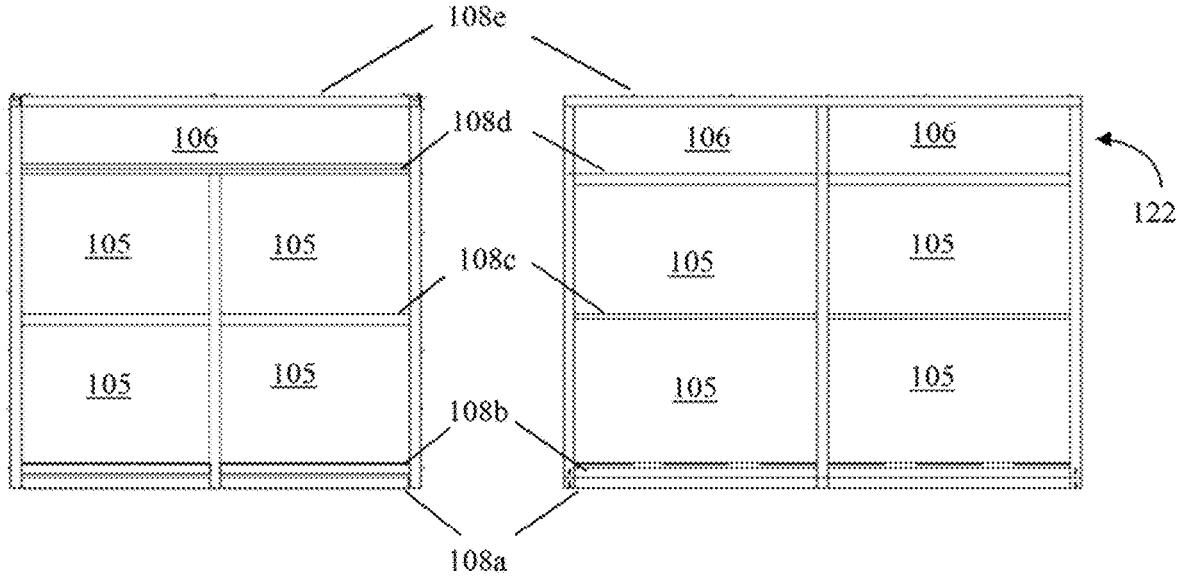
FIG. 12A shows a front view of an exemplary metal frame structure and FIG. 12B shows a side view thereof.
Figure 13:
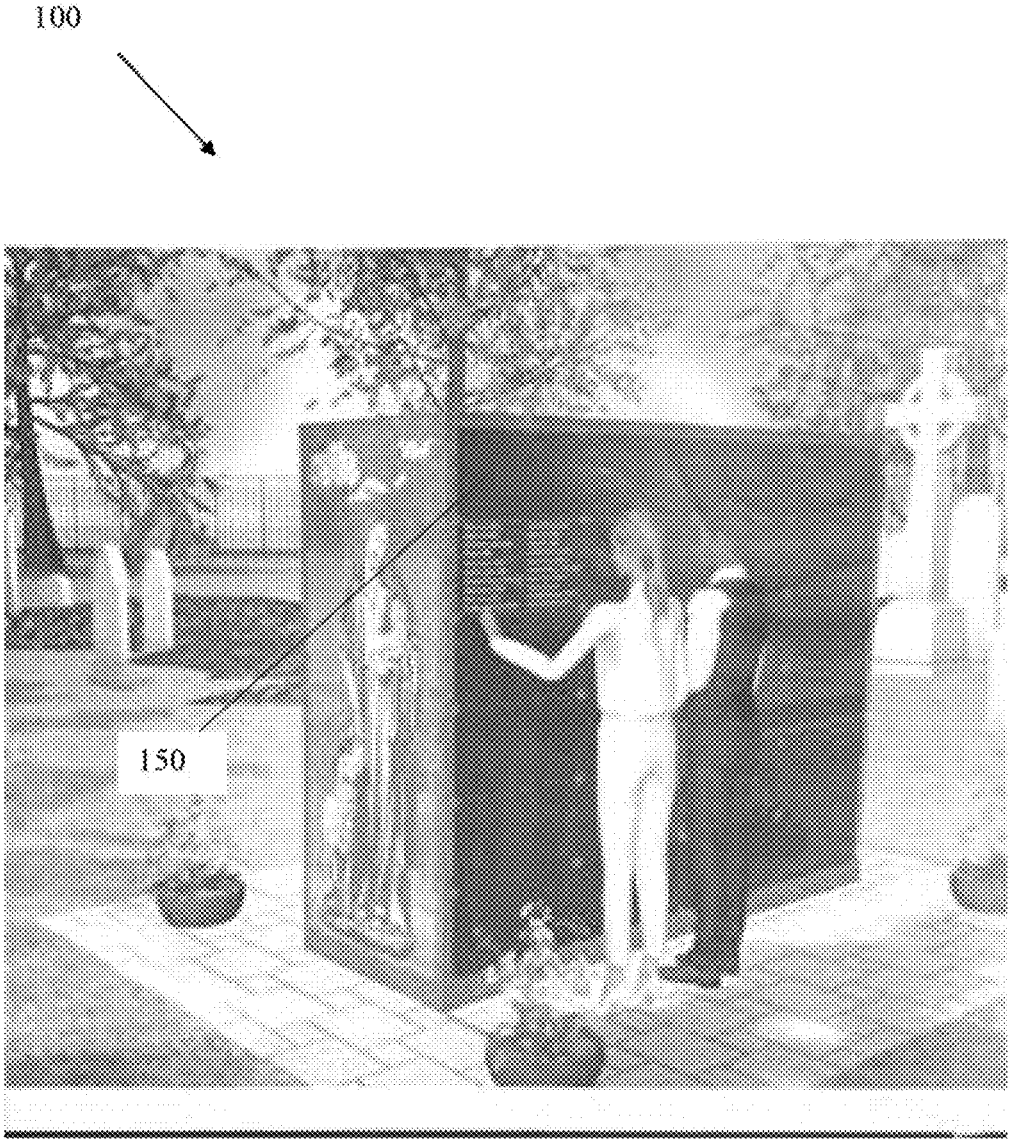
FIG. 13 shows an exemplary hybrid mausolino system.

The fifth level 108*e* may serve as the roof 112 or have a roof 112 secured thereto. (See FIGS. 12-13) The frame structure 102 within the niche area 106 can define horizontal access ports 122. The horizontal access ports 122 are openings leading to the volume of spaces defined by the niche spaces 107. Side panels 150 can be used to removably cover and conceal the niche spaces 107. The niche spaces 107 are horizontally orientated and can be horizontally accessed via removal of a side panel 150 of the system 100 for interment or disinterment. Thus, the access ports 122 can provide horizontal access to the nice spaces 107. Each horizontal access port 122 can be covered and sealed via a side panel 150 removably secured (e.g., via bolts or screws) thereto. The side panel 150 can be metal, stone, etc.

In an alternative embodiment, at least a portion of the roof structure 112 is removable. For instance, the roof structure 112 can include roof panels 114 that are removably attached (e.g., via screws, bolts, latches, etc.) to the roof structure 112. In addition, or in the alternative, the roof panels 114 can be hingedly attached to the roof structure 112. A lintel structure 118 is elevated with respect to the fifth level 108*e* (e.g., the lintel structure 118 resides within the loft area 116) and is attached (e.g., via rivets, bolts, mechanical anchors, epoxy, screws, etc.) to the vertical support beam arrangement 110. The lintel structure 118 includes vertical supports 120 that span a distance between the fifth level 108*e* and the lintel structure 118. The spaced between these vertical supports 120 define access ports 122 to gain access to the niche spaces 107 positioned below the fifth level 108*e*. With embodiments having a removable roof structure 112, it is contemplated for the lintel structure 118 to be configured to receive and removably retain (e.g., via bolts or screws) lids 124 that are positioned over vertically accessible access ports 122. The lids 124 can be metal, stone, etc.

Figure 10A:
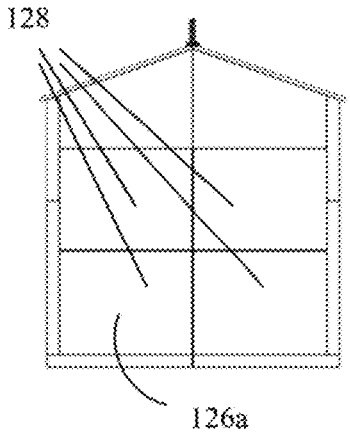
FIG. 10A shows a front view of an exemplary hybrid mausolino with a stone façade.
Figure 10B:
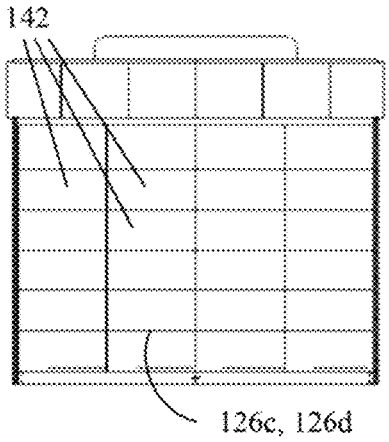
FIG. 10B shows a side view thereof.
Figure 10C:
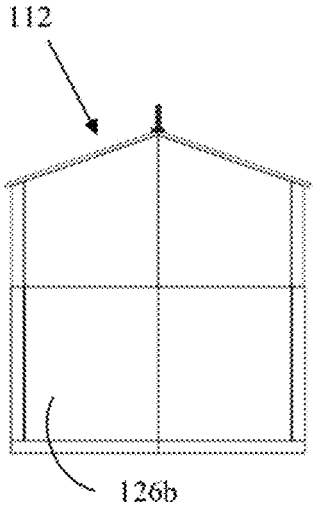
FIG. 10C shows a rear view thereof.
Figure 11:
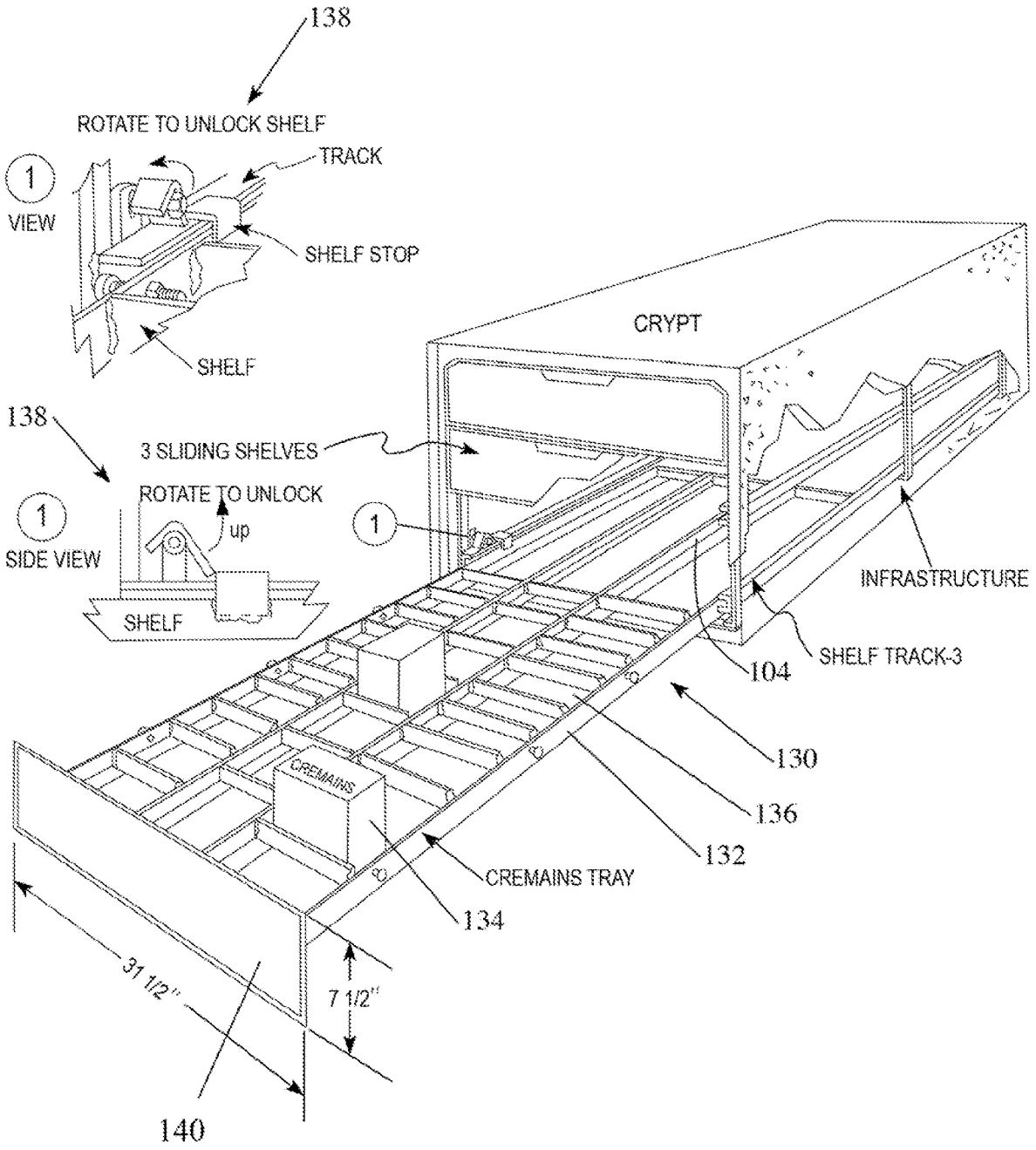
FIG. 11 shows an exemplary track and rail system.

Referring to FIGS. 10-11, the metal frame structure 102 can be cladded with concrete or stone or provided with some other type of façade. For instance, the façade can be stone, granite, marble, etc. slabs secured to the outside face of the metal frame structure 102. In an exemplary embodiment, the mausoleum and/or a columbarium formed by the metal frame structure 102 is a four-sided square or rectangular structure having a front face 126*a*, a rear face 126*b*, and two side faces 126*c*, 126*d*. One or both of the front face 126*a* and rear face 126*b* has face plates 128 that are removably securable (e.g., via bolts or screws) to the front or rear face 126*b*, 126*b*. Any one or both of the side faces 126*c*, 126*d* can have inscription plates 142 secured (e.g., via bolts or screws) thereto.

The interior of the crypt area 104 (e.g., the volume of space between the second and third levels 108 and the volume of space between the fourth and third levels 108) has at least one track and rail system 130 (see FIG. 11) that facilitates extending and retracting shelves 132. Each track and rail system 130 is structured as an extendable and retractable shelf 132 configured to hold a plurality of cremains containers 134 in tray areas 136 of the shelf 132. Each track and rail system 130 is configured to extend from the front face 126*a* to the rear face 126*b* so as to facilitate extending its shelf 132 out from a crypt area/space 104, 105 via the front face 126*a* and retracting its shelf 132 back into the crypt area/space 104, 105 towards the rear face 126*b*. Each shelf 132 has a distal end (the end furthest away from the front face 126*a* when in a retracted position) and a proximal end (the end closest to the front face 126*a* when in a retracted position). The track and rail system 130 includes a lock 138 (e.g., a rotating latch, cotter pin, pin-and-detent, cam lock, etc.) that facilitates locking the shelf 132 at a desired position (e.g., at a fully retracted position, at a fully extended position, or at an intermediate position between the retracted positon and the extended position). The proximal end has a draw plate 140. When in a retracted position, the draw plate 140 is flush or countersunk with the façade of the front face 126*a*. For each shelf 132, a face plate 128 is removably secured (e.g., via bolts or screws) to the front face 126*a* and/or the draw plate 140 when the shelf 132 is in the retracted position. During use, a user removes the face plate 128, extends the shelf 132, inters remains (e.g., places a cremains container 134 in a tray area 136), retracts the shelf 132, and re-secures the face plate 128.

The interior of the niche spaces 107 can have a similarly arranged track and rail system 130 to facilitate extending and retracting similarly situated shelves 132 for the niche areas.

The size, arrangement, and number of track and rail systems 130 will depend on the architectural criteria of the mausoleum and/or a columbarium. In an exemplary embodiment, the volume of space between the second and third levels 108 has three track and rail systems 130 (forming three shelves 132) and the volume of space between the fourth and third levels 108 has three track and rail systems 130 (forming three shelves 132). Again, some embodiments may include a similarly track and rail system 130 (forming one shelf 132) within the volume of space between the fourth and the fifth levels 108.

When interment or interment or disinterment is desired in a niche space 107, the side panel is removed. This is achieved by a user climbing a ladder (if necessary) the mausoleum and/or a columbarium and releasing the fasteners that are securing the selected side panel(s) to gain access to the niche space(s) 107 via the horizontal access port(s) 122. Remains can be inserted to or removed from the niche space(s) 107 via the horizontal access port(s) 122. The user can then re-secure the side panel(s) 124.

When interment or interment or disinterment is desired in a niche space 107 for an embodiment having a removable roof structure 112, the roof structure 112 (or at least one roof panel 114) is removed. This is achieved by a user climbing (e.g., via a ladder) the mausoleum and/or a columbarium and walking along the roof to the roof panel(s) 114 to be opened. The user then releases the fasteners that are securing the selected roof panel(s) 114 to remove the roof panel(s) 114. The user then releases the fasteners that are securing the lid(s) 124 to remove the lid(s) 124 and gain access to the niche space(s) 107 via the vertical access port(s) 122. Remains can be inserted to or removed from the niche space(s) 107 via the vertical access port(s) 122. The user can then re-secure the lid(s) 124 and the roof panel(s) 114.

It should be noted that embodiments having a removable roof structure 112 can also have horizontal access ports 122. Thus, a user has an option to use the vertical or horizontal access ports 122.

Figure 7:
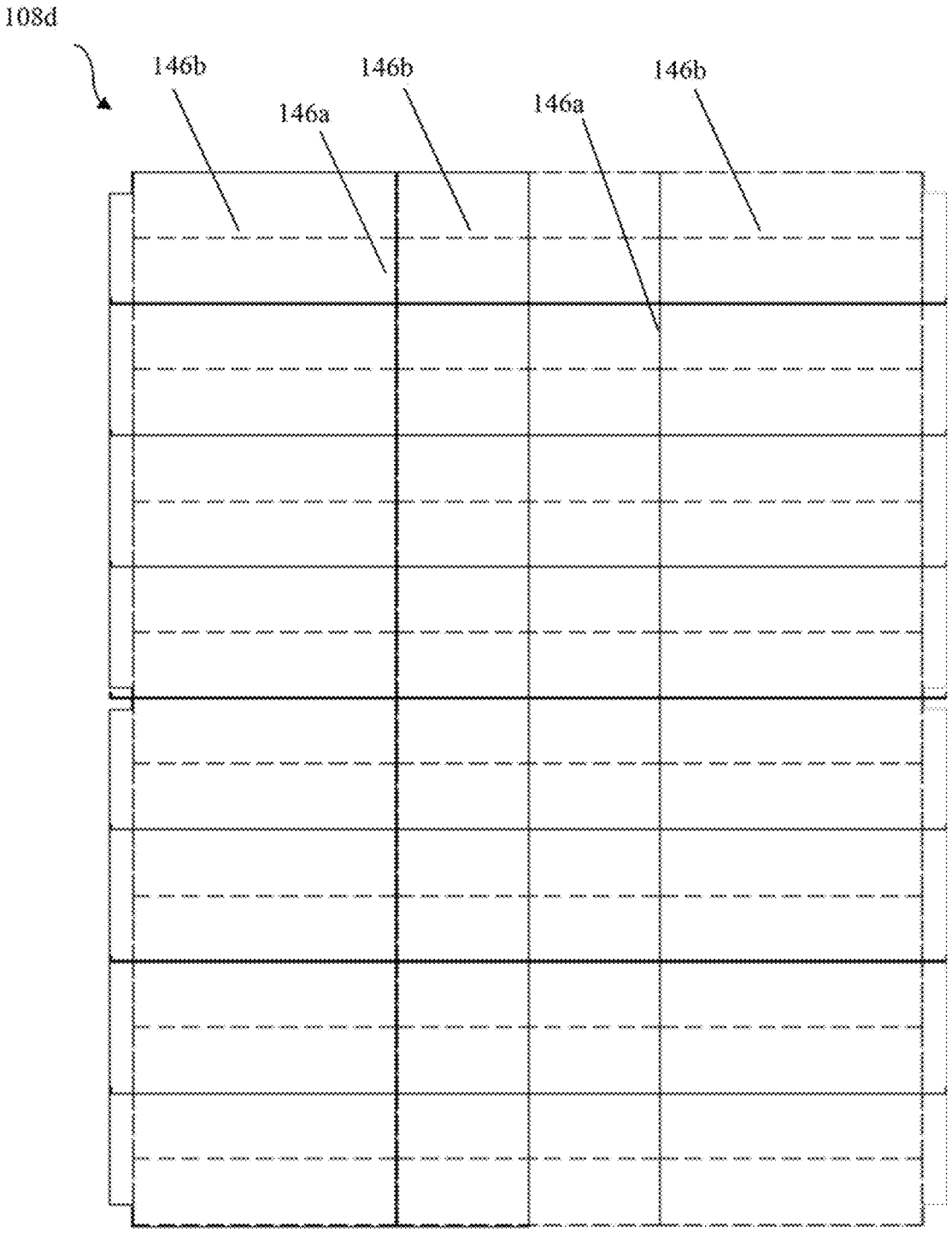
FIG. 7 shows an exemplary top down view of a fourth level of a metal frame structure with inter-locking panels placed thereon.
Figure 8:
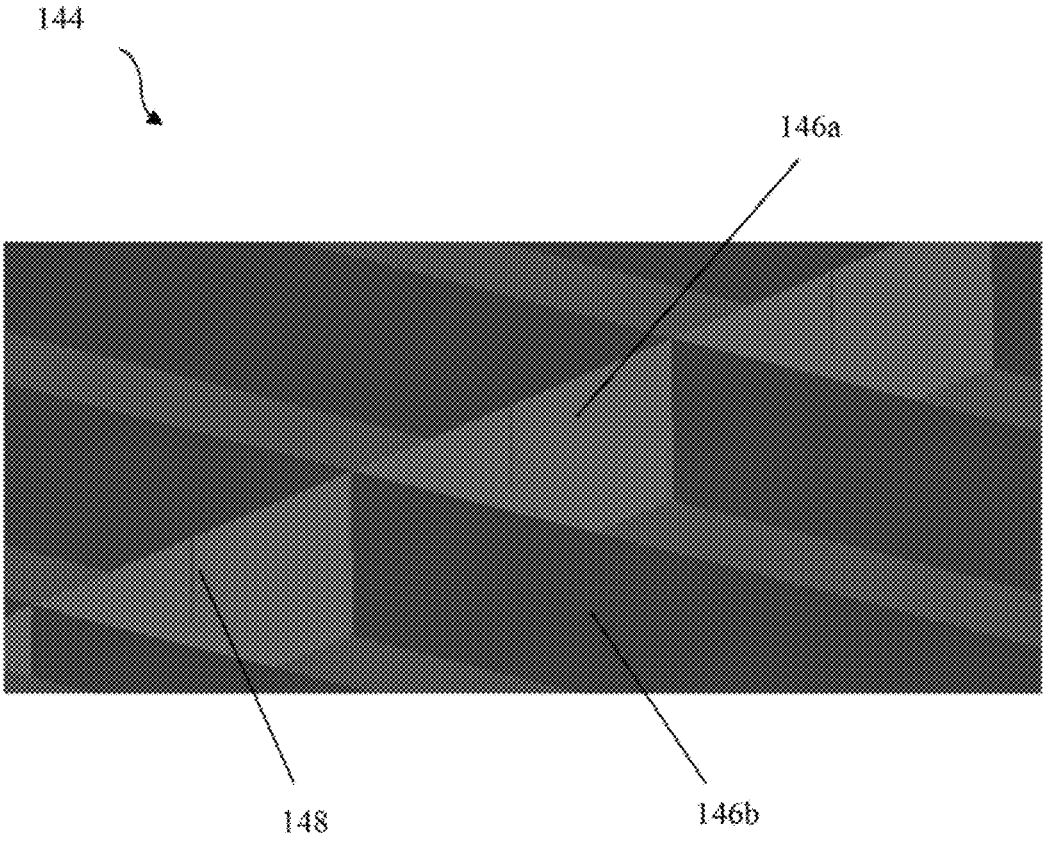
FIG. 8 shows an exemplary inter-locking panel structure.
Figure 9:
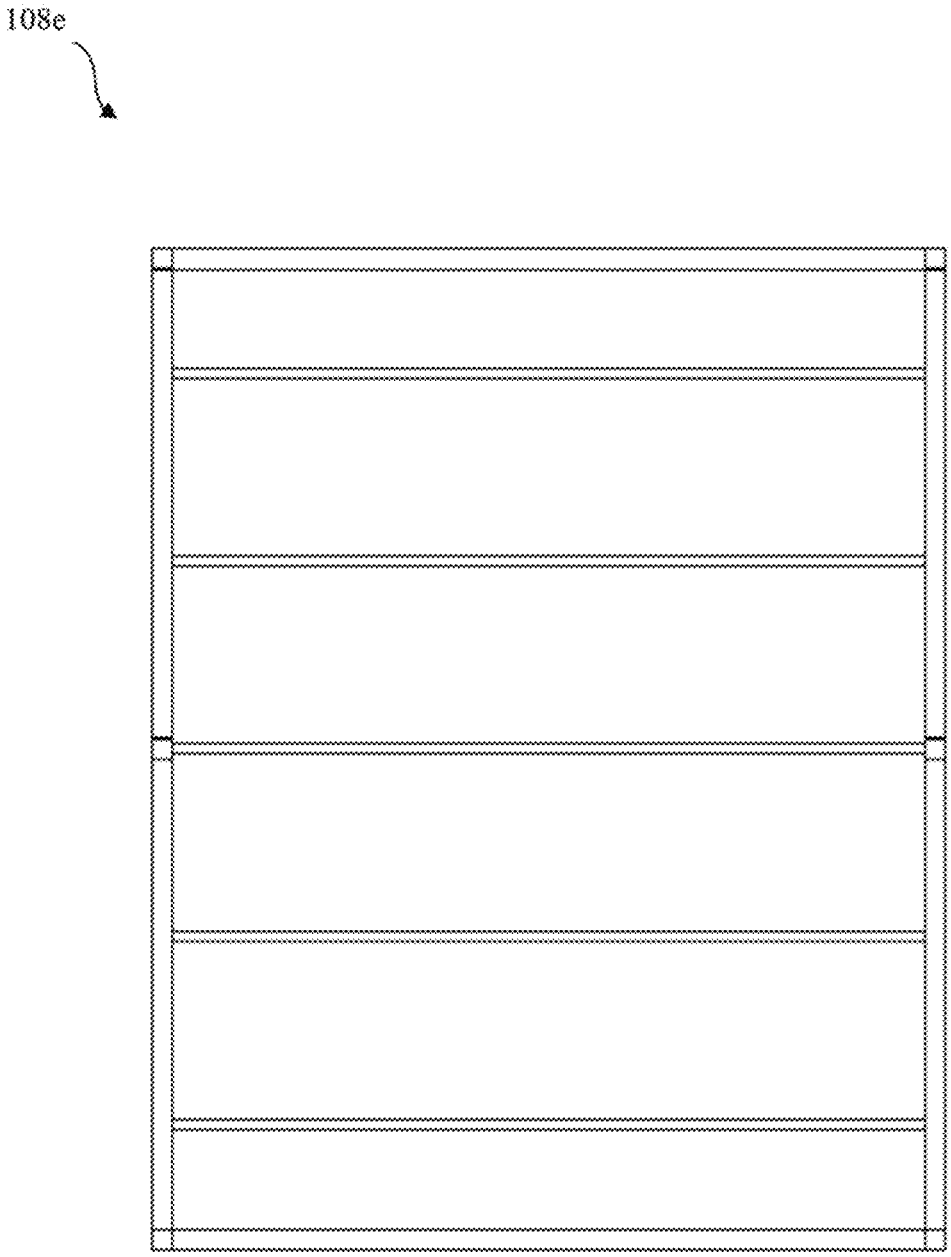
FIG. 9 shows an exemplary top down view of a fifth level of a metal frame structure.

Referring to FIGS. 7-8, each niche space 107 is defined by a plurality of inter-locking panels 144 that partition the volume of space between the fourth and fifth levels 108 into a desired plurality of niche spaces 107. Each panel 146*a*, 146*b* is a rectangular sheet (e.g., metal, stainless steel, steel alloy, aluminum, other metal alloy, plastic, polymer, fiberglass, composite material, etc.). The inter-locking panels 144 include permanently secured panels 146*a* (secured to the metal frame structure 102 and/or the lentil 118) that extend from the front face 126*a* to the rear face 126*b* or extend from the side face 126*c* to the other side face 126*d*. The inter-locking panels 144 also include removably secured panels 146*b* that interlock with the permanently secured panels 146*a*. The removably secured panels 146*b* are secured so as to be orthogonal to the permanently secured panels 146*a*. It is contemplated for the permanently secured panels 146*a* to extend from the front face 126*a* to the rear face 126*b*, and thus the removably secured panels 146*b* will extend in a direction that is from one side face 126*c* to the other side face 126*d*. Any one or both of the permanently secured panels 146*a* and the removably secured panels 146*b* has notches 148 formed therein to facilitate insertion of a panel for the interlock engagement—the interlock engagement allowing for the removable securement of the removably secured panels 146*b* to the permanently secured panels 146*a*. The notch 148 can be formed at any portion of the panel 146*a*, 146*b* (e.g., at the top, the bottom, in the center, etc.). In one embodiment, the permanently secured panels 146*a* have a plurality of notches 148, each notch 148 configured to receive an end of a removably secured panel 146*b*. To cause the removably secured panel 146*b* to interlock with the permanently secured panels 146*a*, the end of the removably secured panel 146*b* is slidably inserted into the notch 148. In some embodiments, the end of the removably secured panel 146*b* is angled (e.g., has an L-shape, Z-shape, etc.) so that the engagement between the removably secured panel 146*b* and the notch 148 is more secure that otherwise would be without an angled shape.

It is contemplated for the inter-locking panels 144 to have two permanently secured panels 146*a* running in parallel with each other so as to extend from the front face 126*a* to the rear face 126*b*. For instance, a first permanently secured panel 146*a* is positioned to be more proximal to a first side face 126*c* and extend from the front face 126*a* to the rear face 126*b*. A second permanently secured panel 146*a* is positioned to be more proximal to a second side face 126*d* and extend from the front face 126*a* to the rear face 126*b*. Each of the two permanently secured panels 146*a* has a plurality of notches 148 formed therein. Each notch 148 facilitates removable securement of a removably secured panel 146*b*. For instance, each notch 148 of the first permanently secured panel 146*a* facilitates removably securement of a removably secured panel 146*b* extending from the first permanently secured panel 146*a* to the first side face 126*c* and/or extending from the first permanently secured panel 146*a* to a corresponding notch 148 (corresponding meaning so that the removably secured panel 146*b* is orthogonal to both the first permanently secured panel 146*a* and the second permanently secured panel 146*a*) of the second permanently secured panel 146*a*. Each notch 148 of the second permanently secured panel 146*a* facilitates removably securement of a removably secured panel 146*b* extending from the second permanently secured panel 146*a* to the second side face 126*d* and/or extending from the second permanently secured panel 146*a* to a corresponding notch 148 (corresponding meaning so that the removably secured panel 146*b* is orthogonal to both the first permanently secured panel 146*a* and the second permanently secured panel 146*a*) of the first permanently secured panel 146*a*.

The volumes of space defined by each permanently secured panel 146*a*, removably secured panel 146*b*, front face 126*a*, rear face 126*b*, first side face 126*c*, and second side face 126*d* are the niche spaces 107. A user can arrange the inter-locking panels 144 so that each notch 148 has a removably secured panel 146*b* or provide a removably secured panel 146*b* for a predetermine number of notches 148. This allows a user to quickly and easily define the number and size of niche spaces 107.

The size, arrangement, and number of permanently secured panels 146*a* and removably secured panel 146*b* will depend on the architectural criteria of the mausoleum and/or a columbarium. It is contemplated for each notch 148 in a permanently secured panels 146*a* to be separated from each other by 6 inches (15.24 centimeters) and for the removably secured panels 146*b* to be 24 inches (60.96 centimeters) in length.

It should be understood that modifications to the embodiments disclosed herein can be made to meet a particular set of design criteria. It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

Therefore, it is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of apparatuses and methods of making and using the same have been discussed and illustrated herein, it is to be distinctly understood that the invention is not limited thereto but may be otherwise variously embodied and practiced within the scope of the following claims.

What is claimed is:

1. A hybrid mausolino system, comprising:

a metal frame structure defining a crypt area and a niche area, the metal frame structure being rectangular in shape and having a front face, a rear face, a first side face, and a second side face; and a plurality of inter-locking panels positioned within the niche area, the plurality of inter-locking panels includes:

opposed first and second permanently secured panels, each permanently secured panel extending from the front face to the rear face and having a plurality of notches formed therein, and a plurality of removably secured panels configured to engage the permanently secured panels via the notches, each removably secured panel oriented in a direction that is orthogonal to the permanently secured panels;

wherein the removably secured panels are reconfigurable to define a desired number of individual niche spaces within the niche area;

wherein the metal frame structure includes an individual access port for each individual niche space, each individual access port granting horizontal access to a respective said individual niche space, each niche space being configured for temporarily interment and disinterment of miscarried stillborn caskets.

2. The hybrid mausolino system recited in claim 1, further comprising:

a roof structure having at least one removable panel, wherein the metal frame structure includes at least one access port to grant vertical access to at least one said niche space.

3. The hybrid mausolino system recited in claim 1, wherein:

the metal frame structure is configured to form a plurality of crypt spaces within the crypt area, each crypt space being configured for interment and memorializing cremation urns.

4. The hybrid mausolino system recited in claim 1, wherein:

each removably secured panel has a distal end that is angled.

5. The hybrid mausolino system recited in claim 1, wherein the volumes of space between the front face, the rear face, the first side face, the second side face, the first permanently secured panel, the second permanently secured panel, and the plurality of removably secured panels define the desired number of niche spaces.

6. The hybrid mausolino system recited in claim 1, further comprising a stone façade applied to the metal frame structure.

7. The hybrid mausolino system recited in claim 1, further comprising:

a façade applied to the metal frame structure; and at least one face plate secured to one or both of the front face and the second face.

8. The hybrid mausolino system recited in claim 1, further comprising:

a façade applied to the metal frame structure; and at least one inscription plate secured to one or both of the first side face and the second side face.

9. The hybrid mausolino system recited in claim 1, wherein:

the metal frame structure has a first level, a second level, a third level, a fourth level, and a fifth level;

a volume of space between the second level and the third level defines a first crypt space of the crypt area;

a volume of space between the third level and the fourth level defines a second crypt space of the crypt area; and a volume of space between the fourth level and the fifth level defines the niche area.

10. The hybrid mausolino system recited in claim 9, further comprising a lintel structure having vertical supports defining access ports.

11. The hybrid mausolino system recited in claim 9, further comprising:

at least one track and rail system arranged within the volume of space between the second level and the third level; and at least one track and rail system arranged within the volume of space between the third level and the fourth level.

12. The hybrid mausolino system recited in claim 1, further comprising:

a track and rail system within the crypt area.

13. The hybrid mausolino system recited in claim 12, wherein the track and rail system forms a shelf and is configured to extend the shelf out from the crypt area and retract the shelf into the crypt area.

14. The hybrid mausolino system recited in claim 13, wherein the shelf defines a plurality of tray areas, each tray area configured to receive a cremains container.

15. The hybrid mausolino system recited in claim 13, further comprising a lock to facilitate locking the shelf at a desired position.

* * * * *